United States Patent [19]

Schneider et al.

[11] Patent Number: 4,638,733

[45] Date of Patent: Jan. 27, 1987

[54] SQUEEGEE HEAD FOR PRINTING OF BODIES BY THE SCREEN PRINTING METHOD

[75] Inventors: Günther Schneider, Tettau/Langenau; Artwin Priebisch, Stockheim, both of Fed. Rep. of Germany

[73] Assignee: Horst Rebhan, Stockheim-Wolferdorf, Fed. Rep. of Germany

[21] Appl. No.: 805,409

[22] Filed: Dec. 5, 1985

Related U.S. Application Data

[63] Continuation of Ser. No. 572,584, Jan. 20, 1984, abandoned.

[51] Int. Cl.[4] ..... B41F 15/44

[52] U.S. Cl. ..... 101/114; 101/121; 101/123; 101/365; 101/119; 101/169

[58] Field of Search ..... 101/114, 119, 120, 125–128, 101/123, 365, 121, 167, 168, 169

[56] References Cited

U.S. PATENT DOCUMENTS

| | | | |
|---|---|---|---|
| 2,645,176 | 7/1953 | Perry | 101/365 |
| 3,330,393 | 7/1967 | Heimlicher | 101/365 X |
| 3,623,430 | 11/1971 | Lessun | 101/365 |
| 3,685,085 | 8/1972 | Jaffa | 101/114 X |
| 3,943,849 | 3/1976 | Vasilantone | 101/123 |
| 4,040,349 | 8/1977 | Jeschke | 101/365 |
| 4,138,943 | 2/1979 | Mitter | 101/119 |
| 4,241,691 | 12/1980 | Hopfe et al. | 101/365 X |
| 4,373,445 | 2/1983 | Köbler | 101/365 |
| 4,393,776 | 7/1983 | Toyoda | 101/365 |
| 4,502,387 | 3/1985 | Jeschke | 101/365 |

FOREIGN PATENT DOCUMENTS

| | | | |
|---|---|---|---|
| 3144435 | 5/1983 | Fed. Rep. of Germany | 101/123 |

*Primary Examiner*—Edgar S. Burr
*Assistant Examiner*—Moshe I. Cohen

[57] ABSTRACT

A squeegee head for the printing of bodies by the screen printing method, the head including a squeegee rubber and a holder for retaining the rubber, the holder comprising a plurality of adjacently arranged holder members which are each guided in the squeegee head for mutually independent reciprocating movement in the contact direction, and are held under a contact force.

9 Claims, 3 Drawing Figures

SQUEEGEE HEAD FOR PRINTING OF BODIES BY THE SCREEN PRINTING METHOD

This application is a continuation of application Ser. No. 572,584, filed 1/20/84, now abandoned.

BACKGROUND OF THE INVENTION

1. Field of the Invention

This invention relates to a squeegee head for the printing of bodies by the screen printing method, and is directed more particularly to a squeegee head having a squeegee rubber member, and a holder for gripping the squeegee rubber member.

2. Description of the Prior Art

In known screen printing methods for effecting printing upon the surfaces of bodies, so-called body printing, or package printing, squeegee (or wiper) heads are used, the heads including a rubber member and a holder therefor. The holder typically consists of two adjacently arranged strips extending over the entire length of the squeegee rubber, clamping the squeegee rubber therebetween.

In order to achieve pressure of the working edges of the squeegee rubber on a screen stencil, which is as flat as possible, the elasticity of the rubber material in such known squeegee heads is utilized. This takes place in such manner that the clamping location of the squeegee rubber between the strips is provided at a certain spacing from the working edge of the squeegee rubber. The rubber material present between the working edge and the clamping location then develops, as a result of its elasticity, an even pressure over the entire length of the working edge during application of the working edge to the screen stencil.

It is disadvantageous in such known squeegee heads, that the elasticity of the squeegee rubber declines after only a relatively short period of use, so that the squeegee rubber deflects and is no longer in the position to produce the contact pressure necessary for a satisfactory printing result. This effect, generally known as "wrap-around", makes frequent replacement of the squeegee rubber necessary so that the period of useful life of such constructions is relatively short.

A further disadvantage of such known squeegee heads consists in that they produce an error-free printing result only upon completely flat printing surfaces. On the other hand, if the bodies to be printed have irregularities in the printing surface, for example caused by constructional necessities, or if certain regions of the surface give way during the printing process to varying extents as a result of differing wall thicknesses, errors result in the printed image which lead to a relatively high rejection rate.

SUMMARY OF THE INVENTION

An object of the present invention is to provide a completely new squeegee head which enables error-free printing results, even on uneven body surfaces, together with higher useful life and lower consumption of squeegee rubbers.

This object is achieved according to the invention in that the holder consists of a plurality of adjacently arranged holder parts, which in the squeegee head are mutually independently guided for reciprocating movement in the contact direction and are held under a contact force.

In accordance with the invention, a squeegee head is provided for the first time in which instead of two strips extending over the entire squeegee rubber length as a holder for the squeegee rubber, a plurality of adjacently arranged and mutually independently displaceable holder parts are provided which are also held under a contact force. As a result of this configuration, the contact force on the working edge is no longer produced by the squeegee rubber material itself but by means which is independent thereof, so that the magnitude of the contact force is completely independent of the elasticity of the squeegee rubber. Greatly increased useful life, with resulting advantages in the consumption of rubber material, are the consequences.

Since, as a result of the separate means for the production of the contact force the squeegee rubber can be clamped at a short distance from its edge, even extremely narrow squeegee rubber strips can be used without disadvantages for the quality of the printing result. This results in a reduction in the squeegee rubber consumption of over 50%. The holder of the squeegee rubber, according to the invention, in mutually independent holder parts, has the further advantage that irregularities in the body upper surface no longer play a great role in the printing result. Thus, as a result of the fixing in mutually independent holder parts, the squeegee rubber during the printing process can better follow any unevenness than in the case of clamping by continuous strips, so that the rejection rate can be reduced by up to 50%. In addition, with the squeegee head constructed according to the invention, even such body upper surfaces can be printed which as a result of unevenness formerly had to be removed before the printing process.

The ability of a squeegee head constructed according to the invention to be able to adapt better to irregularities than known squeegee heads leads also to improved printing results with bodies having various wall thicknesses along the printing length. Thus, the working edge of the squeegee rubber can better follow thinner wall regions which have a greater tendency than thick wall regions to give way, so that even in such cases improved printing results can be achieved.

A particularly essential advantage of a squeegee head according to the invention consists, however, in that without difficulties it is even possible to print on surfaces which, considered over the length of the printing image—have various radii of curvature. Thus, the squeegee rubber, as a result of its being held in mutually independent holder parts, can easily follow a change in radius during the printing process so that even those surfaces can be printed whose radius of curvature markedly changes along the length of the printing image.

Experiments have shown that a particularly flexible stretching of the squeegee rubber is produced if the holder parts are not arranged directly adjacent but at a small spacing from one another. This spacing is dependent upon the Shore hardness and the thickness of the squeegee rubber material.

Furthermore, it is advantageous if the displacement path of the holder parts is limitable in the contact direction by adjustable stops. In this manner, where necessary a form adapted to the upper surface to be printed can be imparted to the squeegee rubber.

The contact force for the individual holder parts can be produced in various ways. For example, in order to produce the contact force, spring means, or air, or hydraulic force can be provided. From a technical viewpoint, the simplest solution, however, consists in the production of the contact force by mechanical pressure springs, such as coil springs.

In a preferred embodiment, each holder part consists of a clamp head for the squeegee rubber, which is guided in the squeegee head and which is connected to a guide pin on its side averted from the squeegee rubber. Such a configuration is relatively simple to construct and not susceptible to faults.

The above referred-to stops can be provided in various manners. It is, however, advantageous if the stops are formed in each case from a nut with a lock nut which is arranged on a thread of the guide pin.

The guide pins can be connected to the clamp head in various manners. A particularly advantageous construction is achieved however if the guide pin rests in a bore of the clamp head and is held by a cross pin.

The securing of the squeegee rubber on the holder parts can be achieved in various manners. It is advantageous if the holder parts have a clamp slot for the squeegee rubber. This clamp slot can be constructed in the usual manner from two mutually adjustable clamping jaws. A particularly simple construction is however achieved if the clamp slot is formed only from a groove whose breadth is slightly smaller than the breadth of the squeegee rubber. Experiments have shown that such a configuration is fully sufficient to fasten a squeegee rubber securely in the holder portion of the clamp head. As concerns working with a squeegee rubber which has an approximately rectangular cross-section, it is expedient that the clamping slot is inclined at an angle to the contact direction. By this means, the squeegee rubber is mounted obliquely so that one of its edges operates as a working edge.

BRIEF DESCRIPTION OF THE DRAWINGS

In the following, for further explanation and for better understanding two exemplary embodiments of the invention are described in more detail with reference to the accompanying drawings.

In the drawings.

DESCRIPTION OF THE PREFERRED EMBODIMENTS

Figure 1:
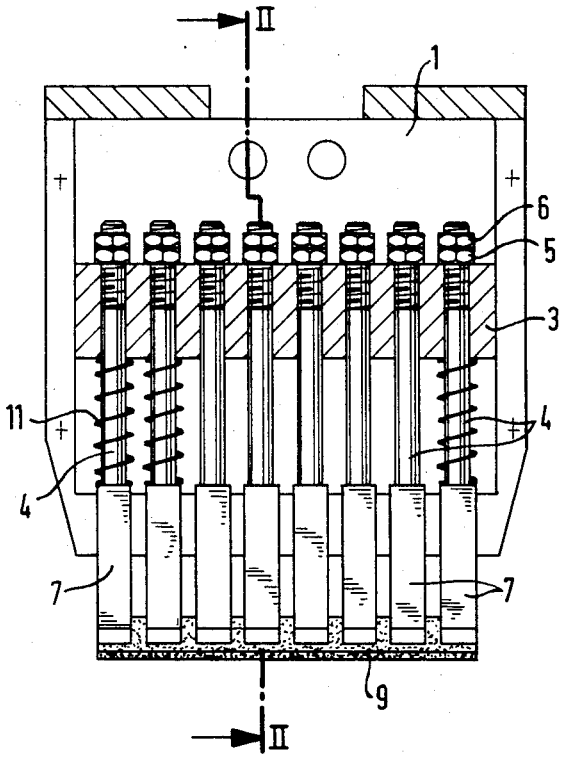
FIG. 1 is a front elevational view of a preferred exemplary embodiment of a squeegee head according to the invention in which for the purpose of improved clarity one of the cover plates enclosing the inner chamber is removed.

As appears from the drawings, the squeegee head consists of a flat box-like housing 1, whose front face comprises a removable cover plate 2. In the inner chamber of the housing 1 is arranged a strip 3 which has a plurality of aligned bores for guide pins 4 which carry on their first end a nut arrangement consisting of a nut 5 and a lock nut 6, and on their second end, in each case, a clamp head 7. The clamp heads 7 in the exemplary embodiment, shown in FIGS. 1 and 2, have an approximately rectangular cross-section and are guided in slots in the housing of the squeegee head for reciprocating movement.

The clamp heads 7 have, in the region of their chamfered front surfaces, housing clamping slots 8 for the reception of a squeegee rubber 9 which in the present case has an approximately rectangular cross-section. The clamping slots 8 are furthermore inclined at an angle to the contact direction, which, in the present case, extends in a plane through the axis of the guide pins 4.

Figure 2:
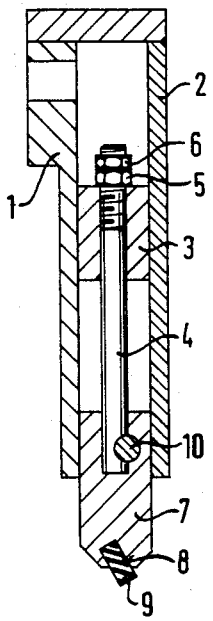
FIG. 2 is a sectional view of the embodiment according to FIG. 1, taken along the plane II—II of FIG. 1.

In the exemplary embodiment illustrated in FIGS. 1 and 2, the pins 4 rest in bores of the clamp heads 7. The fastening of the guide pins 4 to the clamp heads 7 may be achieved by means of cross pins 10.

Between the strip 3 and the clamp heads 7, pressure springs 11 (not shown in FIG. 2) of a predetermined spring force are provided on the guide pins 4.

Figure 3:
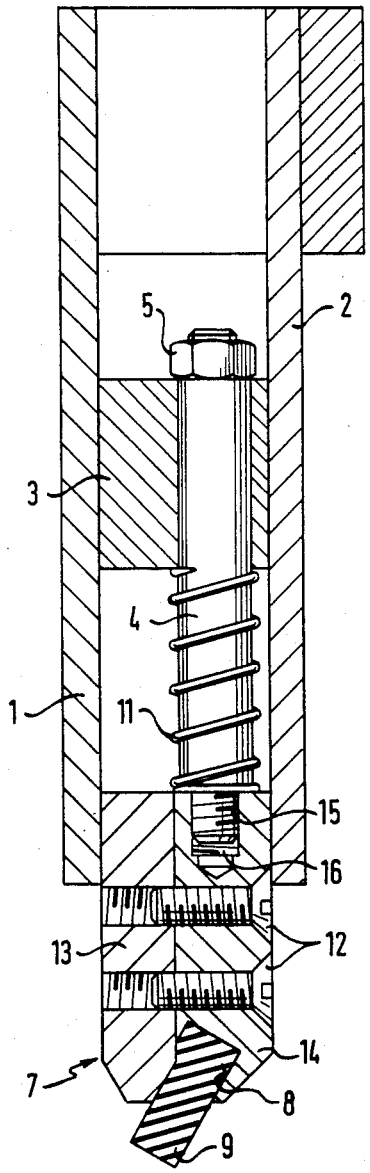
FIG. 3 is a sectional view, similar to FIG. 2, but showing at an enlarged scale a second exemplary embodiment of a squeegee head, according to the invention.

In the alternative embodiment represented in FIG. 3, the clamp heads 7 consist, in each case, of two clamp jaws 13 and 14 which are mutually connected by screws 12 and between which the squeegee rubber 9 is clamped.

In the exemplary embodiment of FIG. 3, the guide pin 4 is equipped on its end opposite to the nut 5 with a threaded peg 15 which is screwed into a screw-threaded bore 16 of the clamp head 7.

Having thus described our invention, what we claim as new and desire to secure by Letters Patent of the United States is:

1. A squeegee head assembly for printing by the screen printing method, said squeegee head assembly comprising an elongated squeegee rubber having a contact edge and a base edge and a holder retaining said base edge of said rubber, said holder including a plurality of clamp heads, each clamp head being connected at an individual point along the length of said base edge, said holder further including a holder mounting strip having bores therein, a plurality of holder members comprising rods mounted parallel to each other and each slidably in one of said bores for independent reciprocating movement in said bores, respectively, during a printing operation, individual biasing means mounted on each of said rods between said clamp head and said holder mounting strip to yieldingly bias said clamp heads individually in a contact direction, means connecting each of said rods to one of said clamp heads, and adjustable stop means carried by each of said rods on the end remote from said clamp head, said rubber base edge being fixed to said independently moveable clamp heads at said points along the length of said rubber, said rubber contact edge being urged thereby yieldably against a working surface, thereby being conformed to said surface during said printing operation.

2. A squeegee head assembly according to claim 1 in which said holder members are spaced from one another.

3. A squeegee head assembly according to claim 1, in which said adjustable stop means comprises lock nut means.

4. A squeegee head assembly according to claim 1, including cross pins interconnecting said holder members and said clamp heads.

5. A squeegee head assembly according to claim 1, in which said clamp heads are each provided with a clamp slot adapted to retain said rubber.

6. A squeegee head assembly according to claim 5, in which said clamp heads each include adjustable clamping jaws adapted to define said clamp slot.

7. A squeegee head assembly according to claim 5, in which said clamp slot comprises a groove having a width smaller than a non-compressed width of said rubber.

8. A squeegee head assembly according to claim 5, in which said clamp slot is inclined at an angle to the axes of said rods.

9. A squeegee head assembly according to claim 1 in which said rubber contact edge is disposed further from said rods than said rubber base edge, and said contact edge is adapted for contact with said working surface in said printing operation.

* * * * *